United States Patent [19]

Bertani

[11] Patent Number: 4,574,503

[45] Date of Patent: Mar. 11, 1986

[54] IRONING BOARD SUPPORT FOR IRON AND AUXILIARY STEAM GENERATOR

[75] Inventor: Carlo Bertani, Montechiarugolo, Italy

[73] Assignees: AL-PI S.r.l., Milan; B e B S.r.l., Montechiarugolo, both of Italy

[21] Appl. No.: 617,487

[22] Filed: Jun. 5, 1984

[30] Foreign Application Priority Data

Jul. 7, 1983 [IT] Italy ..... 22304/83[U]
Jul. 7, 1983 [IT] Italy ..... 22305/83[U]
Jul. 7, 1983 [IT] Italy ..... 22306/83[U]

[51] Int. Cl.[4] ..... D06F 81/02

[52] U.S. Cl. ..... 38/77.6; 38/107; 38/DIG. 2; 219/275; 248/117.1; 312/27

[58] Field of Search ..... 38/77.6, 107, 142, DIG. 2, 38/DIG. 1; 312/27, 273, 266, DIG. 33; 108/93; 248/117.1, 117.2, 117.5; 219/271, 275, 273; 16/370

[56] References Cited

U.S. PATENT DOCUMENTS

| | | | |
|---|---|---|---|
| 1,656,789 | 1/1928 | Haskin | 38/107 X |
| 2,247,438 | 7/1941 | Gorton | 38/77.6 |
| 2,322,648 | 6/1943 | Lundstrom | 312/27 |
| 2,624,828 | 1/1953 | McCracken et al. | 38/77.6 X |
| 2,634,526 | 4/1953 | McGraw | 38/77.6 |
| 2,739,398 | 3/1956 | Carlsen | 38/107 |
| 2,822,229 | 2/1958 | Carlson | 312/27 |
| 3,406,999 | 10/1968 | Kozicki | 312/266 X |
| 3,690,024 | 9/1972 | Osrow | 219/275 X |
| 3,722,973 | 3/1973 | Textoris | 312/27 X |
| 3,857,623 | 12/1974 | Schneller | 312/266 |

FOREIGN PATENT DOCUMENTS

| | | | |
|---|---|---|---|
| 172028 | 1/1934 | Switzerland | 312/266 |
| 2072711 | 10/1981 | United Kingdom | 38/107 |

*Primary Examiner*—Werner H. Schroeder
*Assistant Examiner*—Andrew M. Falik
*Attorney, Agent, or Firm*—Balogh, Osann, Kramer, Dvorak, Genova & Traub

[57] ABSTRACT

An ironing board supported by collapsible legs to which a box-shaped body can be connected either fixedly or in a removable manner. This body is provided with a specific housing suitable to accommodate an iron interconnected to a steam boiler by a fluid passage duct. The steam boiler may be formed directly in one of the collapsible legs supporting the board or carried, in a substantially vertical position, by one of said legs. Also, the steam boiler may be incorporated in the box-shaped body.

7 Claims, 6 Drawing Figures

IRONING BOARD SUPPORT FOR IRON AND AUXILIARY STEAM GENERATOR

BACKGROUND OF THE INVENTION

1. Field of the Invention

The present invention pertains to an ironing apparatus for home use.

2. Prior art

It is known that besides the traditional irons, a new type of apparatus for steam ironing is becoming more popular. In this type of apparatus the steam is produced outside the iron, in a small boiler connected to the iron by a flexible conduit through which the steam passes.

Such apparatus have some advantages with respect to the traditional steam-irons; particularly, the apparatus has more abundant steam at one's disposal and allow the use of a light weight iron. These features make ironing less arduous. Furthermore, in such apparatus the servicing is easier because calcareous deposits are only formed in the steam boiler and not in the iron to obstruct the steam emitting holes in the iron. However the drawback of such known apparatus is their bulkness which presents as a storage problem. On these collapsible boards.

However, it is not possible to place a boiler of the above type; in fact, besides taking up room to an already reduced working surface, it would be in an unsteady and dangerous position.

Furthermore, when the ironing board is put away in a storeroom, it is necessary to have space to store the ironing apparatus.

SUMMARY OF THE INVENTION

It is therefore an object of the present invention to provide an ironing apparatus overcoming the above mentioned drawbacks of the known art, while keeping all the advantages thereof.

This object is substantially achieved by an ironing apparatus for home use comprising a steam iron, a steam boiler, an ironing table having at least an ironing board, collapsible legs supporting said board, and a housing suitable to receive the iron, wherein the boiler is engaged with the table under the ironing board and wherein the ironing table comprises a box-shaped body suitable to define at least a housing for the iron and engaged with the working board in an underneath position with respect to the same.

Further features and advantages of the invention will become more apparent from the detailed description of some preferred embodiments given hereinafter by way of example only with reference to the accompanying drawings.

DESCRIPTION OF THE PREFERRED EMBODIMENTS OF THE INVENTION

Figure 1:
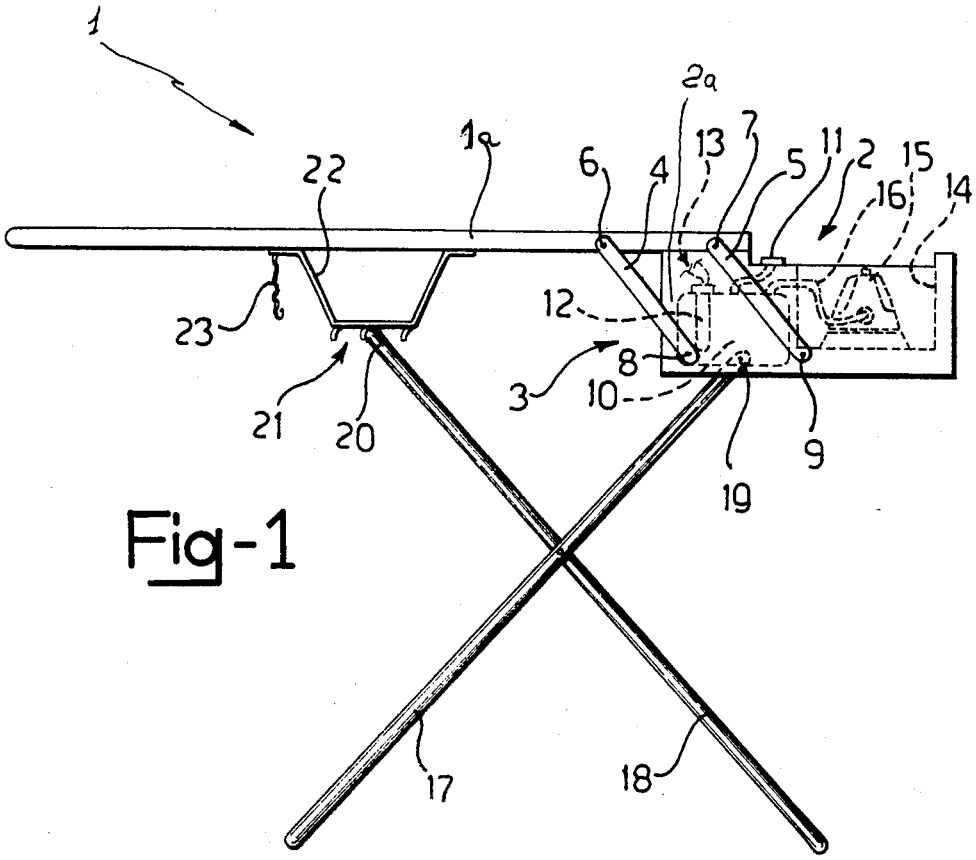
FIG. 1 is a side view of one embodiment of the apparatus according to the invention in its use position.
Figure 2:
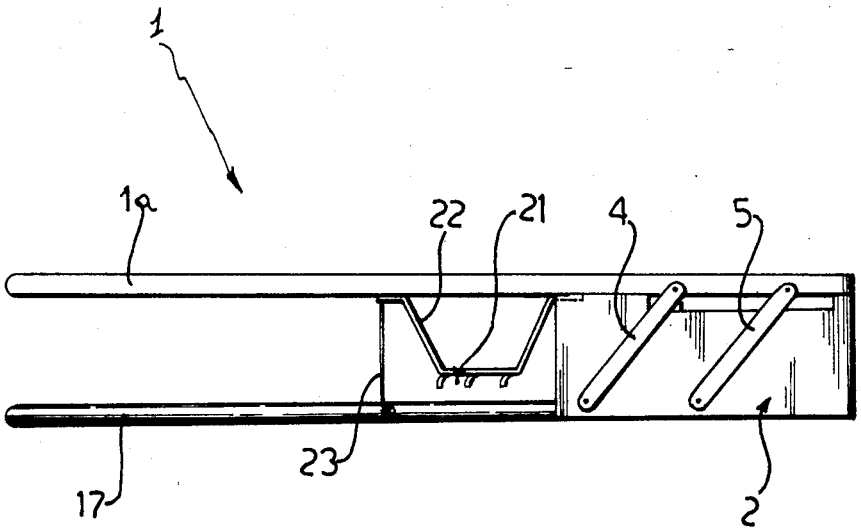
FIG. 2 is a side view of the apparatus seen in FIG. 1 in a folded up position.

Referring to FIGS. 1 and 2, it has been indicated at 1 an ironing table provided with an ironing board 1*a* and collapsible legs 17, 18. At 2 it has been indicated a box-shaped body associated with the ironing board 1*a*. The body 2 is supported by board 1*a* by means of a pair of identical articulated quadrilaterals, more particularly articulated parallelograms, only one of which is shown in the figures, generally indentified at 3. Parallelogram 3 comprises two similar and parallel connecting rods 4 and 5, articulated at one end thereof, 6 and 7 respectively, to the board 1*a* and at their other ends 8 and 9 to body 2. In this way, the body 2 is movable with respect to board 1*a* from a position protruding from the board itself to a retracted position below said board, reference being made to the orientation that board 1*a* has when in its use position (as seen in the figures).

A small steam boiler 10 is accommodated inside body 2 in a specific space 2*a*. This boiler 10 is of the conventional type and is provided with a filler 11 and a glow plug 12 connected to electric wires 13.

Always inside body 2, close to the boiler 10, a housing 14 is formed for receiving an iron 15. Iron 15 is of the steam type and is in flow communication with boiler 10 through a steam passage duct 16.

The ironing apparatus comprises said collapsible legs 17 and 18. More particularly, leg 17 is articulated to body 2 at one end 19 thereof, while legs 17 and 18 are articulated to each other substantially in the middle to form an X shape. One end 20 of leg 18 is then engaged in a removable and selective manner with one of a number of recesses 21, formed on a frame 22 fixed to the lower part of the board 1*a*.

The above described ironing apparatus can take different use positions and a folded up position. In its use position (FIG. 1) body 2 protrudes from board 1*a* so that the iron 15 put away in housing 14 becomes accessible; legs 17 and 18 support board 1*a*; end 20 is in engagement with one of the recesses 21 the choice of which is based on the desired height from the floor of board 1*a*, while end 19, acting on body 2, keeps it in a protruding position.

In a folded up position (FIG. 2) body 2 is retracted under the board 1*a*, so that housing 14 is closed and the total bulkiness is reduced; legs 17 and 18 are folded up under the board 1*a* where they are retained by a rubber band 23.

Figure 3:
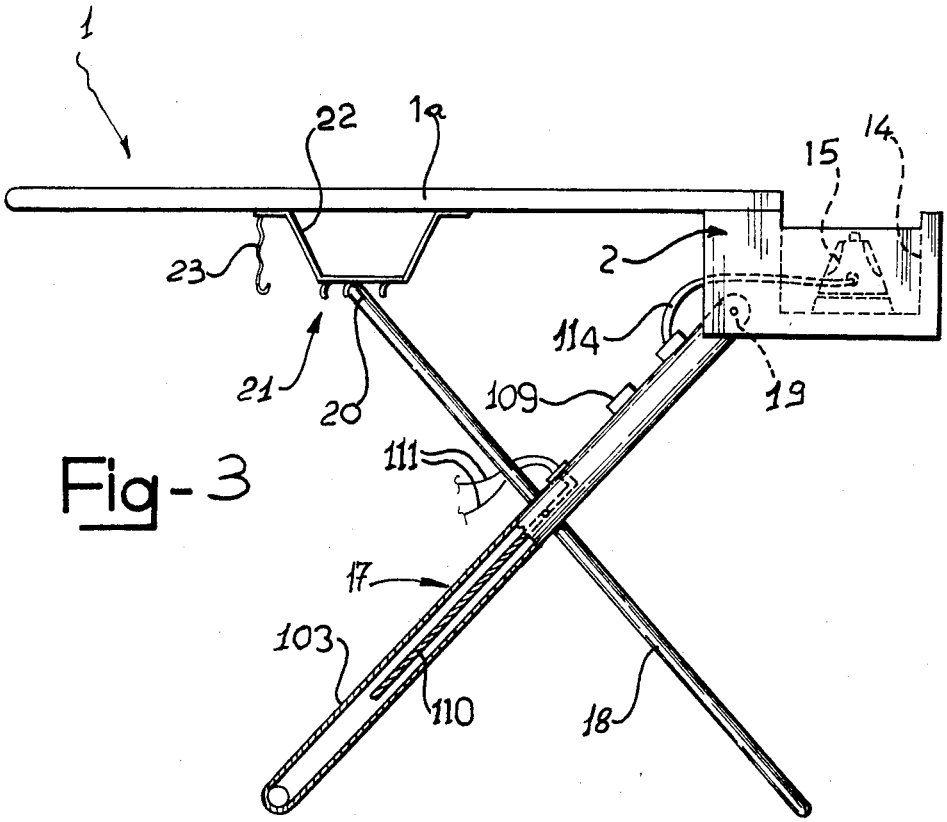
FIG. 3 is a side view of a second embodiment of the apparatus in its use position.
Figure 4:
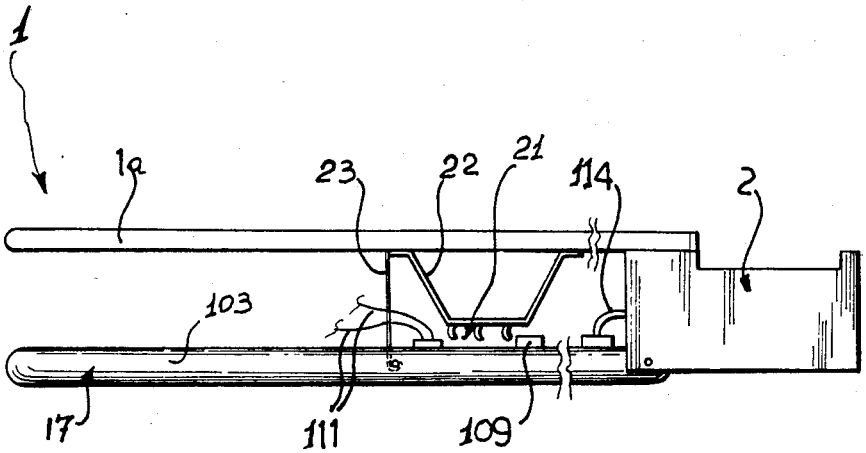
FIG. 4 shows the apparatus seen in FIG. 3 in a folded up position.

In the second embodiment shown in FIGS. 3 and 4 there is provided a box-shaped body 2 rigidly fastened to the board 1*a* and provided with a single space 14. In addition, leg 17 is intended to be made from a tubular metal member 103 of rather larger diameter so that it can be used as steam boiler by itself. For the purpose, it is provided with all usual equipments normally present in traditional boilers; more particularly, the boiler-like leg comprises a filler 109 and a glow plug 110 connected to electric wires 111. The irons 15 is in flow communication with the boiler-like leg through a steam passage duct 114.

Figure 5:
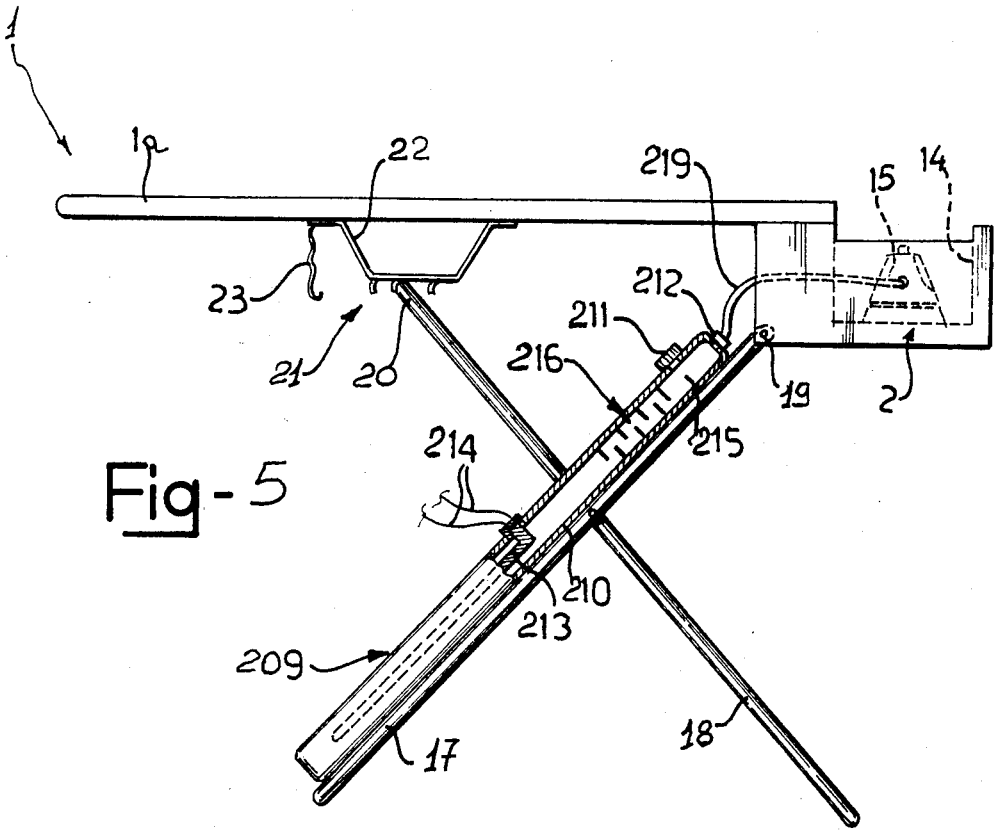
FIG. 5 is a side view of a third embodiment of the apparatus in question in its use position.
Figure 6:
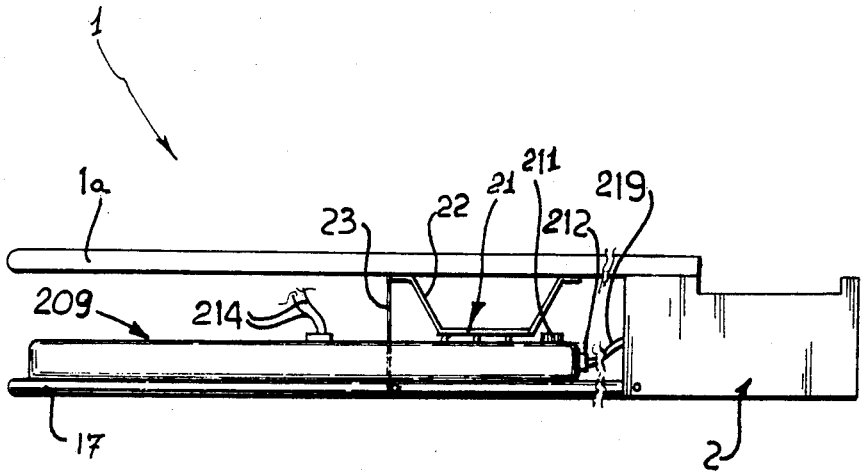
FIG. 6 shows the apparatus seen in FIG. 5 in a folded up position.

The third embodiment shown in FIGS. 5 and 6 is similar to that seen in FIGS. 3 and 4, but leg 17 does not by itself define a boiler. In fact an eventually removable steam boiler 209 is fastened in a substantially vertical position to leg 17. It comprises a tubular body 210 for the water to be vaporized, which is provided with a filler 211 and a steam outlet 212.

In the lower part of the tubular body 210 there is fitted a conventional heating member, such as for example a glow plug 213 connected to electric wires 214. A steam dome 215 is formed in the upper part of the tubular body 210, in the vicinity of which there are the openings 211 and 212.

The tubular body 210 is also provided, at the inside thereof, with a labyrinth trap 216 preventing the vaporized water trailed by steam from coming out.

The iron 15 is in flow communication with boiler 209 through a steam passage duct 219.

The advantages of the apparatus according to the invention appear obvious. In fact it allows to enjoy all the advantages of an iron with separated boiler also when it is not possible to have a table at one's disposal. This is due to the fact that it embodies a board which is exactly similar to that of a normal collapsible ironing board.

It should be also noted that this apparatus, when folded up, only occupies a slightly larger space than a normal ironing board.

What is claimed is:

1. An ironing apparatus comprising a steam iron, a steam boiler, an ironing table having at least an ironing board, collapsible legs supporting said board, and a housing suitable to receive said iron, means for supporting said boiler under said ironing board, said ironing table comprises a box-shaped body suitable to define at least a housing for said iron and means for securing said body to said working board in an underneath position with respect to the same, wherein said body is supported in a removable manner by said ironing board by means of an articulated quadrilateral linkage comprising at least two connecting rods articulated, at one end thereof, to said body and, at the other end thereof, to the ironing board, said body being movable about said linkage from a first use position in which it protrudes from said board to a second retracted position in which it is disposed under the same board, wherein said steam boiler is formed in one of said collapsible legs, said iron adapted to be accommodated in said housing of said body being in flow communication with said boiler through a steam passage duct extending from said collapsible leg defining said boiler.

2. An ironing apparatus according to claim 1, wherein said body is fitted between said ironing board and one of said collapsible legs.

3. An ironing apparatus according to claim 1, wherein said box-shaped body is fixedly secured to said ironing board.

4. An ironing apparatus comprising a steam iron, a steam boiler, an ironing table having at least an ironing board, collapsible legs supporting said board, and a housing suitable to receive said iron, means for supporting said boiler under said ironing board, said ironing table comprises a box-shaped body suitable to define at least a housing for said iron and means for securing said body to said working board in an underneath position with respect to the same, wherein said body is supported in a removable manner by said ironing board by means of an articulated quadrilateral linkage comprising at least two connecting rods articulated, at one end thereof, to said body and, at the other end thereof, to the ironing board, said body being movable about said linkage from a first use position in which it protrudes from said board to a second retracted position in which it is disposed under the same board, wherein said steam boiler is supported by one of said collapsible legs, said boiler being defined by a tubular body for the water to be vaporized, said body being provided with a filler and a steam outlet, a steam dome formed at the top of said tubular body, a labyrinth trap formed in said tubular body and suitable to prevent the non-vaporized water from coming out, as well as with a steam passage duct in flow communication with said steam outlet and with the iron.

5. An ironing apparatus according to claim 4, wherein said steam boiler is supported by one of said collapsible legs in a removable manner.

6. An ironing apparatus comprising a steam iron, a steam boiler, an ironing table having at least an ironing board, collapsible legs articulated to one another to form a substantially 'X' like shape when supporting said board, and a housing suitable to receive said iron, means for supporting said boiler under said ironing board, said ironing table comprises a box-shaped body suitable to define at least a housing for said iron and means for securing said body to said working board in an underneath position with respect to the same, wherein one of said legs is fixedly attached to said box shaped body and the other leg is removably attached to said ironing board and wherein said body is supported in a removable manner by said ironing board by means of an articulated quadrilateral lateral comprising at least two connecting rods articulated, at one end thereof, to said body and, at the other end thereof, to the ironing board, said body being movable about said linkage from a first use position in which it protrudes from said board to a second retracted position in which it is disposed under the same board, said one collapsible leg and said articulated quadrilateral cooperatively defining a mechanism for swinging said box-shaped body with said steam generator through a substantial angular range between erected and collapsed positions.

7. An ironing apparatus according to claim 1, wherein said body extends in such a way that it defines, close to said housing, a space suitable to accommodate said boiler and substantially hidden by said ironing board.

* * * * *